US008322175B2

(12) United States Patent
Stoeger et al.

(10) Patent No.: US 8,322,175 B2
(45) Date of Patent: Dec. 4, 2012

(54) WORKPIECE AND METHOD FOR EXPLOSION FORMING

(75) Inventors: Philipp Stoeger, Wildenduernbach (AT); Alexander Zak, Moedling (AT)

(73) Assignee: Cosma Engineering Europe AG, Oberwaltersdorf (AT)

( * ) Notice: Subject to any disclaimer, the term of this patent is extended or adjusted under 35 U.S.C. 154(b) by 788 days.

(21) Appl. No.: 12/520,192

(22) PCT Filed: Dec. 6, 2007

(86) PCT No.: PCT/EP2007/010632

§ 371 (c)(1), (2), (4) Date: Jun. 19, 2009

(87) PCT Pub. No.: WO2008/080502

PCT Pub. Date: Jul. 10, 2008

(65) Prior Publication Data

US 2010/0011827 A1 Jan. 21, 2010

(30) Foreign Application Priority Data

Dec. 20, 2006 (DE) ..... 10 2006 060 372

(51) Int. Cl.
*B21D 26/06* (2006.01)

(52) U.S. Cl. ..... 72/56; 72/430; 72/706; 29/421.2

(58) Field of Classification Search ..... 72/54, 56, 72/430, 706; 29/421.2
See application file for complete search history.

(56) References Cited

U.S. PATENT DOCUMENTS

| | | | | |
|---|---|---|---|---|
| 392,635 | A | 5/1933 | Powers | |
| 3,131,661 | A * | 5/1964 | Granberg | 72/56 |
| 3,160,949 | A | 12/1964 | Bussey et al. | |
| 3,206,963 | A * | 9/1965 | Ida et al. | 72/56 |
| 3,252,312 | A | 5/1966 | Maier | |
| 3,342,048 | A | 9/1967 | Johnson et al. | |
| 3,600,921 | A | 8/1971 | Schwarz | |
| 3,640,110 | A | 2/1972 | Inoue | |
| 3,646,792 | A * | 3/1972 | Hertel et al. | 72/56 |
| 3,654,788 | A | 4/1972 | Kimura | |
| 3,661,004 | A | 5/1972 | Lee et al. | |
| 1,280,451 | A | 7/1972 | Hagen | |
| 3,712,022 | A * | 1/1973 | Erlandson | 72/56 |
| 3,737,975 | A | 6/1973 | McKinnon, Jr. | |
| 3,742,746 | A | 7/1973 | Erlandson | |
| 4,187,709 | A | 2/1980 | Roland et al. | |
| 4,471,640 | A | 9/1984 | Kortenski et al. | |
| 4,492,104 | A | 1/1985 | Weaver et al. | |
| 4,494,392 | A | 1/1985 | Schroeder | |

(Continued)

FOREIGN PATENT DOCUMENTS

| | | |
|---|---|---|
| AT | 248838 | 8/1966 |

(Continued)

*Primary Examiner* — David B Jones

(74) *Attorney, Agent, or Firm* — Dickinson Wright PLLC

(57) ABSTRACT

It shall be achieved by the invention that a workpiece for an explosion forming process, which can be inserted into a forming tool and which can be deformed from an initial shape by means of explosion forming, and the explosion forming method are improved such that a satisfactory quality of the workpiece with the desired wall thickness is achieved in a simple manner. This object is achieved by a workpiece and a respective explosion forming method in which the initial shape of the workpiece has at least in some portions a supply of material for the explosion forming process, which is preformed compared to adjoining portions or which is provided therewith.

17 Claims, 3 Drawing Sheets

U.S. PATENT DOCUMENTS

| | | | |
|---|---|---|---|
| 4,571,800 | A | 2/1986 | Faupell |
| 4,738,012 | A | 4/1988 | Hughes et al. |
| 4,788,841 | A | 12/1988 | Calhoun et al. |
| 4,856,311 | A | 8/1989 | Conaway |
| 5,187,962 | A | 2/1993 | Bilko et al. |
| 5,220,727 | A | 6/1993 | Hochstein |
| 5,339,666 | A | 8/1994 | Suzuki et al. |
| 5,377,594 | A | 1/1995 | Alford |
| 5,890,698 | A | 4/1999 | Domytrak |
| 2006/0060601 | A1 | 3/2006 | Kubacki et al. |

FOREIGN PATENT DOCUMENTS

| | | | |
|---|---|---|---|
| AT | 276032 | | 11/1969 |
| AT | 371384 | | 6/1983 |
| CH | 409831 | | 10/1966 |
| DE | 1452667 | U | 12/1938 |
| DE | 1218986 | | 1/1967 |
| DE | 1235246 | B1 | 3/1967 |
| DE | 1129562 | | 10/1968 |
| DE | 1452665 | A1 | 5/1969 |
| DE | 1452667 | A1 | 5/1969 |
| DE | 1527949 | A1 | 11/1969 |
| DE | 1801784 | A1 | 6/1970 |
| DE | 1808942 | A1 | 6/1970 |
| DE | 2043251 | | 9/1970 |
| DE | 1777207 | A1 | 4/1971 |
| DE | 1777208 | A1 | 4/1971 |
| DE | 2043251 | | 3/1972 |
| DE | 2059181 | A1 | 6/1972 |
| DE | 2107460 | A1 | 8/1972 |
| DE | 2357295 | A1 | 5/1974 |
| DE | 2337176 | A1 | 6/1975 |
| DE | 114231 | | 7/1975 |
| DE | 2622317 | A1 | 1/1977 |
| DE | 2628579 | A1 | 12/1977 |
| DE | 2908561 | A1 | 10/1979 |
| DE | 158364 | | 12/1983 |
| DE | 3341488 | A1 | 5/1984 |
| DE | 3305615 | A1 | 8/1984 |
| DE | 217154 | A1 | 1/1985 |
| DE | 3590248 | C2 | 6/1986 |
| DE | 3512015 | A1 | 10/1986 |
| DE | 260450 | A1 | 9/1988 |
| DE | 3709181 | A1 | 9/1988 |
| DE | 4035894 | C1 | 1/1992 |
| DE | 4232913 | C2 | 4/1994 |
| DE | 19536292 | | 4/1997 |
| DE | 19638679 | A1 | 3/1998 |
| DE | 19638688 | A1 | 3/1998 |
| DE | 19709918 | A1 | 9/1998 |
| DE | 19818572 | C1 | 11/1999 |
| DE | 19852302 | A1 | 5/2000 |
| DE | 19915383 | B4 | 10/2000 |
| DE | 19957836 | A1 | 6/2001 |
| DE | 10328154 | A1 | 12/2004 |
| DE | 102005025660 | A1 | 12/2006 |
| DE | 102006056788 | | 12/2006 |
| DE | 102007007330 | | 2/2007 |
| DE | 102007023669 | | 5/2007 |
| DE | 102006008533 | A1 | 8/2007 |
| DE | 102007036196 | | 8/2007 |
| DE | 102006019856 | A1 | 11/2007 |
| DE | 102006037754 | B3 | 1/2008 |
| DE | 102008006979 | | 1/2008 |
| DE | 102006037742 | A1 | 2/2008 |
| DE | 102006060372 | A1 | 6/2008 |
| EP | 0151490 | A2 | 8/1985 |
| EP | 148459 | B1 | 11/1987 |
| EP | 0288705 | A2 | 11/1988 |
| EP | 00371018 | B1 | 7/1992 |
| EP | 0592068 | A1 | 4/1994 |
| EP | 0590262 | B1 | 4/1996 |
| EP | 0765675 | A2 | 4/1997 |
| EP | 0830906 | A1 | 3/1998 |
| EP | 0830907 | A2 | 3/1998 |
| EP | 1702695 | A2 | 9/2006 |
| EP | 1849551 | A2 | 10/2007 |
| FR | 1342377 | A | 9/1963 |
| FR | 2300322 | A1 | 2/1975 |
| FR | 2280465 | | 2/1976 |
| FR | 7503396 | | 9/1976 |
| GB | 742460 | | 6/1952 |
| GB | 878178 | A | 9/1961 |
| GB | 1129562 | A | 10/1968 |
| GB | 1280451 | A | 7/1972 |
| GB | 1419889 | | 12/1975 |
| GB | 1436538 | | 5/1976 |
| GB | 1501049 | A | 2/1978 |
| GB | 1542519 | A | 3/1979 |
| GB | 2009651 | A | 6/1979 |
| GB | 2047147 | A | 11/1980 |
| JP | 55-139128 | A | 10/1980 |
| JP | 58145381 | A | 8/1983 |
| JP | 2117728 | A | 5/1990 |
| JP | 739958 | | 2/1995 |
| JP | 70505176 | | 2/1995 |
| JP | 2001054866 | A | 2/2001 |
| JP | 2002093379 | A | 3/2002 |
| JP | 2007-222778 | A | 9/2007 |
| WO | 9933590 | A2 | 7/1999 |
| WO | 0000309 | A1 | 1/2000 |
| WO | 2004028719 | A1 | 4/2004 |
| WO | 2006128519 | A | 12/2006 |
| WO | 2008098608 | A1 | 8/2008 |
| WO | 2009095042 | A1 | 8/2009 |

* cited by examiner

WORKPIECE AND METHOD FOR EXPLOSION FORMING

CROSS-REFERENCE TO RELATED APPLICATIONS

This application is a national entry application of PCT Application WO 2008/080502 filed on Dec. 6, 2007, entitled "Workpiece and Method for Explosion Forming" and claiming priority from German Patent No. 10 2006 060 372 filed on Dec. 20, 2006, entitled "Werkstück und Verfahren für das Explosionsumformen" (Workpiece and Method for Explosion Forming), the disclosures of which are incorporated herein by reference for all purposes.

FIELD OF THE INVENTION

The invention relates to a workpiece and a method for explosion forming.

BACKGROUND OF THE INVENTION

Various methods exist for forming a workpiece. In hydroforming for example, a tubular workpiece is filled by a liquid, usually water, and is subsequently sealed. By increasing the liquid pressure the workpiece is expanded and gradually adapts to the contours of the forming tool surrounding the workpiece.

An explosion forming method of the above-mentioned kind not using a liquid is described in EP 592 068. To manufacture a camshaft a mold is fit with the prefabricated cams and is closed after an internally hollow camshaft shaft is passed through the openings of the individual cams. The ends of the closed mold are sealed by sealing elements and a spark plug projecting into the camshaft shaft is screwed-in. After the shaft has been filled by a combustible gas, it is ignited by means of the spark plug. Caused by the sudden rise of the gas pressure in the interior of the shaft, this shaft is expanded and pressed into the openings of the individual cams. The cams are therefore axially connected with the camshaft shaft in a manner fixed for co-rotation.

This document discusses the conventional disadvantages of explosion forming. Due to the shock wave following the detonation, the workpiece tends to local formation of tension and cracks. The high peak pressure generated causes an inconstant flow of material, which can lead to differences in wall thickness. In EP 592 068 it is proposed to cure this in that the forming pressure is carried out by a deflagration instead of an explosion (detonation). A detonation is based on a chemical reaction of the explosive(s) and propagates by shock wave induced combustion. A superposition of the pressure wave with the volume expansion takes place, which leads to the higher speed and multiple pressure compared to a deflagration. Contrary thereto, a deflagration is a fast combustion process which propagates by the heating-up of the unused mixture. The pressure reached by the gas expansion is approximately 10 bar and the speed is significantly lower than the speed of sound.

This approach failed to be implemented in practice due to the fact that on the one hand a deflagration is less process safe and, on the other hand, the speed and the forming pressure are lower compared to a detonation.

SUMMARY OF THE INVENTION

The object on which the present invention is based is to improve an explosion forming process of the above-mentioned kind in that a satisfactory quality of the workpiece having the desired wall thickness, and is achieved in a simple manner.

This object is solved according to the invention by a workpiece comprising the features of claim 1.

This supply of material is deformed by the detonation and can be used to obtain a desired wall thickness in desired potions of the workpiece. By supplying material, the flow of material can be improved during the forming process through the amount of material available. At the same time a more regular forming of the workpiece can be obtained and the shaping thereof can be supported. The pre-formed supply of material can also serve for producing a satisfactory wall quality of the workpiece. The shape, size an position of the pre-formed supply of material can therefore adapt to the final shape of the workpiece and/or at the course of the detonation front.

In a favorable embodiment of the invention, the pre-formed supply of material has a de-formed portion of the workpiece. A supply of material pre-formed in this manner can easily be achieved by a forming molding of the workpiece itself and can well be adapted to the final shape of the workpiece.

In a special embodiment of the invention, the pre-formed supply of material has a material portion additionally applied to the workpiece. This additionally applied foreign material is well suitable for a clearly restricted pre-formed supply of material and can be positioned very precisely at the workpiece.

The pre-formed supply of material advantageously consists of a portion of a greater wall thickness. The material provided in this manner can well be engaged by the detonation front and can for instance serve for forming cavities.

In a favorable embodiment, the pre-formed supply of material is arranged on the outer side relating to the forming direction. On the outer side means in this sense the side of the workpiece opposing the explosion space. A pre-formed supply of material at the outer side is especially suitable for deforming bulges of the workpiece and is usually well accessible.

In an embodiment the pre-formed supply of material is arranged on the inner side relating to the deformation direction. This can be advantageous if tighter tolerances and an improved surface quality compared to the inner side are required.

It can be advantageous to form the pre-formed supply of material in a somewhat punctiform manner. A supply of material pre-formed in this manner can be advisable especially in small indentations or bulges of the forming tool at this position.

In a variant the pre-formed supply of material extends in a manner extending approximately linearly. A supply of material pre-formed in this manner can support forms extending uniaxially, e.g. shoulders in the forming tool.

In a special manner the pre-formed supply of material can be formed approximately plane. A plane design can for instance be advantageous to form an expanded portion of a larger wall thickness. It can also be composed of punctiform and/or linear designs having the cited advantages.

In an advantageous embodiment, the pre-formed supply of material consists of at least one indentation and/or bulge and/or recess and/or elevation in the wall of the workpiece. In a further favorable embodiment, the pre-formed supply of material consists of at least one flute and/or rib and/or fold and/or wave and/or shoulder and/or groove. Depending on the final shape of the workpiece or the cavity of the forming tool, the deformation process can suitably be influenced in critical portions by such forms of the pre-formed supply of material, which can easily be applied in practice.

The pre-formed supply of material can advantageously be formed in a manner extending transversely with respect to the longitudinal extension of the workpiece. This design is especially suitable if the re-forming work is large transversely with respect to the longitudinal extension of the workpiece.

In a modification, the pre-formed supply of material is formed longitudinally with respect to the longitudinal extension of the workpiece. This modification is recommended if the deformation work in this direction is large.

In a favorable modification of the invention, the pre-formed supply of material extends over the circumference of the workpiece. A supply of material pre-formed in this manner can serve for re-forming workpieces with tubular sections.

The above-mentioned object is solved by an explosion forming method comprising the features of claim 15.

This pre-formed supply of material is utilized in the explosion forming method and locally increases the amount of material available for the deformation process, which can be used for improving the flow of material. The material provided in this way can be deposited again at relevant portions to achieve the desired shape or wall thickness there. In practice, the pre-formed supply of material can be formed in a simple manner and at low cost by known methods at the workpiece, e.g. by re-forming of thermal joining.

The pre-formed supply of material can advantageously be manufactured by deforming a portion of the workpiece. This deformation can easily be achieved by forming molding, e.g. by squeezing, bending or by tumbling, and can easily be integrated into the process chain without great effort and without great cost.

In a variant of the invention, the pre-formed supply of material is manufactured by depositing additional material to the workpiece. This material portion deposited can be generated quickly, e.g. by build-up welding or by welding on additional material, and the method step can also be integrated into the manufacturing process in a simple and cost-effective manner.

The pre-formed supply of material can be formed before inserting the workpiece into the forming tool. Thereby the supply of material can be formed separately and the forming tool can be optimized with respect to the explosion forming process.

BRIEF DESCRIPTION OF THE DRAWINGS

Exemplary embodiments of the invention will now be described in conjunction with the following drawings wherein like numerals represent like elements, and wherein:

FIG. 2 shows variants of the supply of material pre-formed according to the invention by means of sections of the workpiece, wherein FIG. 2*a* shows an indentation and a bulge, respectively FIG. 2*b* shows a flute and a groove, respectively FIG. 2*c* shows various folds, FIG. 2*d* shows a wave, FIG. 2*e* shows a material portion additionally deposited, and FIG. 2*f* shows a groove and two shoulders.

DETAILED DESCRIPTION OF THE PREFERRED EMBODIMENTS

Figure 1:
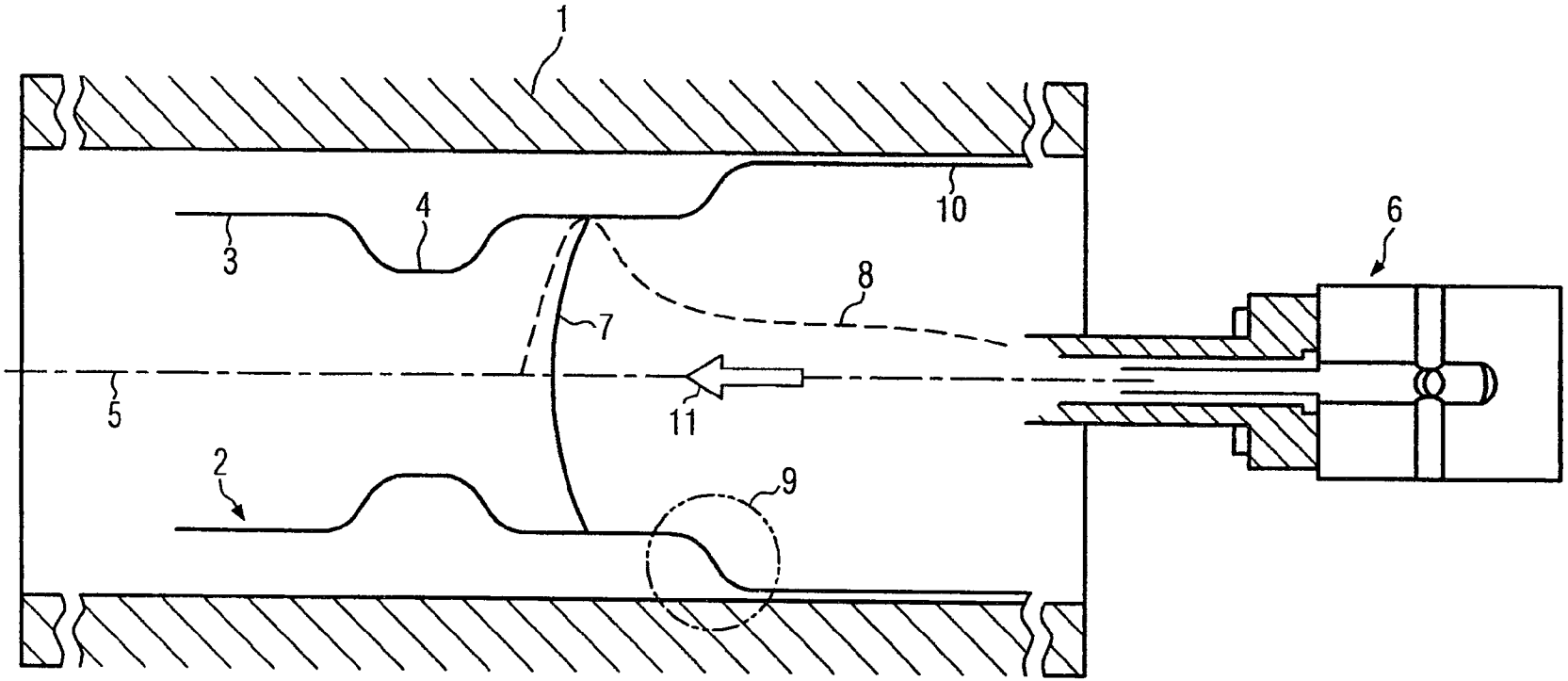
FIG. 1 schematically shows the principle of the invention by means of a section through the forming tool and the workpiece with a pre-formed supply of material.

FIG. 1 schematically shows a section through a closed forming tool 1. In this forming tool a workpiece 2 is shown in its initial form 3 with a pre-formed supply of material 4. The dash-dot line 5 indicates an axis of symmetry of the workpiece 2 and/or a possible separation plane of the forming tool.

A gas mixture in the interior of the workpiece 2 is ignited by an ignition means 6. A detonation front 7 extends from the ignition means 6 to the opposite end of the forming tool 1 into a propagation direction 11 and gives the workpiece 2 a pressure course 8, which is shown in dotted lines.

The actual forming takes place in a zone indicated by 9, which follows the detonation front 7 at a short delay and which develops a final shape 10 of the workpiece 2. This material forming zone 9 takes the inertia of the material and the delayed deformation into account with respect to displaying.

During the deformation work the pre-formed supply of material 4 serves for controlling the flow of material in the material forming zone 9. Caused by the material provided, the wall thickness and quality of the final shape 10 can be influenced for relevant portions of the workpiece 2. The pre-formed supply of material 4 thus adapts in the most favorable manner concerning shape, position and design, to the course of the detonation front 7 and to the desired final shape 10. Furthermore, the pre-formed supply of material 4 is especially suitable to supply shapes of the forming tool 1 to be impressed on the workpiece 2 with additional material during the deformation process, especially portions of a large deformation work.

The forming tool 1 is shown with outer walls with a constant spacing to line 5, and the workpiece 2 is shown with a pre-formed supply of material 4, which is formed in a peripheral flute-like manner. This supply of material 4, as well as the initial design 3, is still spaced apart from the forming tool 1. By the effect of the detonation front 7 the following material forming zone 9 pushes the supply of material 4 forward and deposits it in a re-formed manner in the area of the desired greater wall thickness so that it rests in its initial design 3 against the outer walls until it reaches its final design 10. The supply of material 4 can also serve for forming indentations or bulges of the forming tool 1 in this area.

Figure 2:
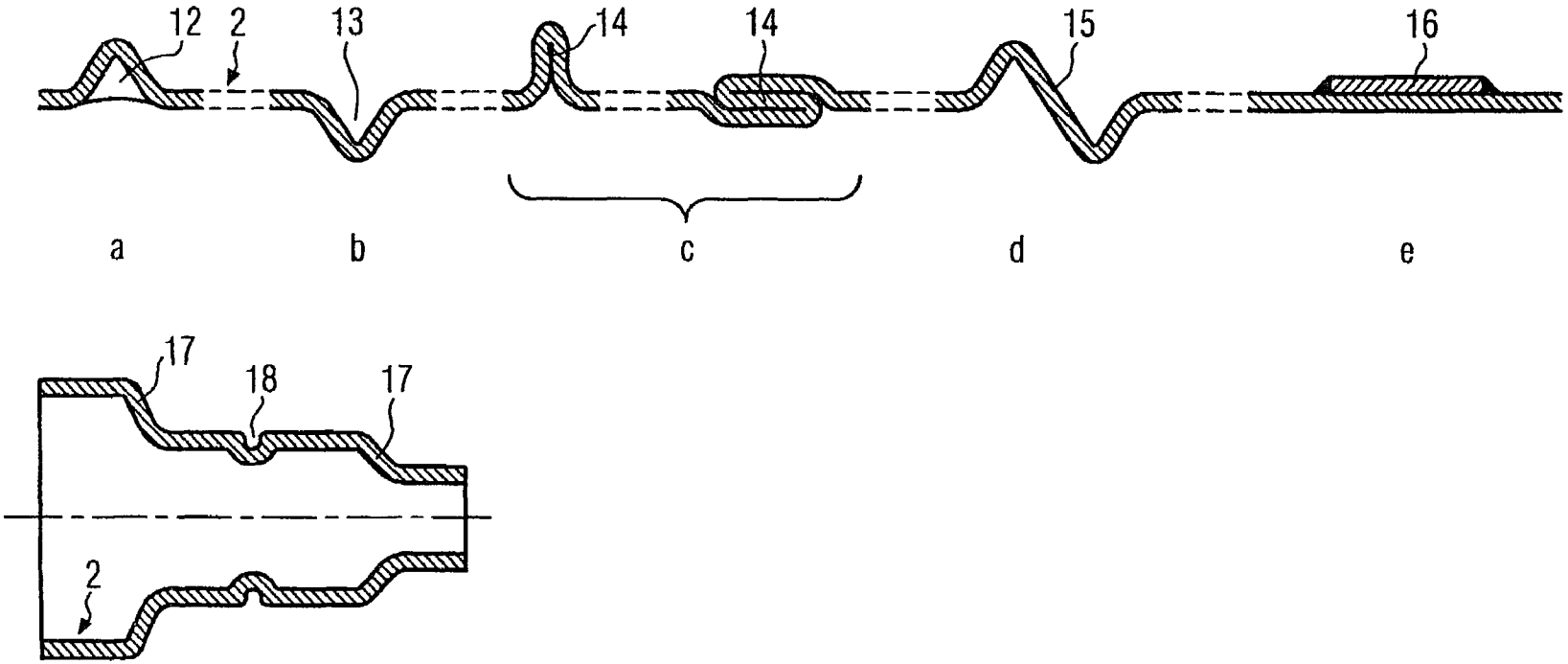

FIG. 2 shows different embodiments of the pre-formed supply of material 4 on the workpiece 2. FIG. 2*a* to 2*d* and 2*f* show pre-formed portions of the supply of material 4, and contrary thereto an additionally deposited portion in FIG. 2*d*. Examples of a pre-formed supply of material 4, which can be located on the external and/or inner side relating to the forming direction, are shown in FIG. 2*a* to 2*e*.

FIG. 2*a* shows a bulge 12 and a punctiform design of the pre-formed supply of material 4. This may for instance be a bulge which can for instance easily be formed by the beat of a hammer from the opposite side.

FIG. 2*b* shows a recess 13 of the pre-formed supply of material 4 with respect to the workpiece 2, and thus somewhat linear extension, namely a flute, which can for instance be folded.

FIG. 2*c* shows examples of a fold 14 and thus also a linear extension of the pre-formed supply of material 4. Such folds 14 can quickly be achieved by an aimed upsetting process or multiple folding of the workpiece 2.

FIG. 2*d* shows an embodiment of a wave in the workpiece 2 and thus to also manufacture an approximately linear extension of the pre-formed supply of material 4, e.g. by rolling, pressing or tumbling.

FIG. 2*e* shows an embodiment of a material portion 16 additionally deposited to the workpiece 2, said material portion being a sheet welded-on forming the pre-formed supply of material 4 with a thicker wall thickness, and which can be formed somewhat punctiform, linearly extending or planarly, depending on the respective dimensions.

FIG. 2*f* shows the supply of material 4 of the workpiece 2, which extends across the circumference of the workpiece 2, which is in this case rotational symmetrical. The pre-formed supply of material 4 is formed in this embodiment as two shoulders 17 and one groove 18. In this partial Figure, a tubular workpiece is shown, wherein the invention is not restricted to this basic shape of a workpiece.

The supplies of material shown in FIG. 2 can also be designed in the counter direction; then, the bulge or dent 12 towards the outer side in FIG. 2*a* becomes an indentation or dint towards the inside, and the recess or flute 13 towards the inside in FIG. 2*b* becomes an elevation or rib towards the outside.

Figure 3:
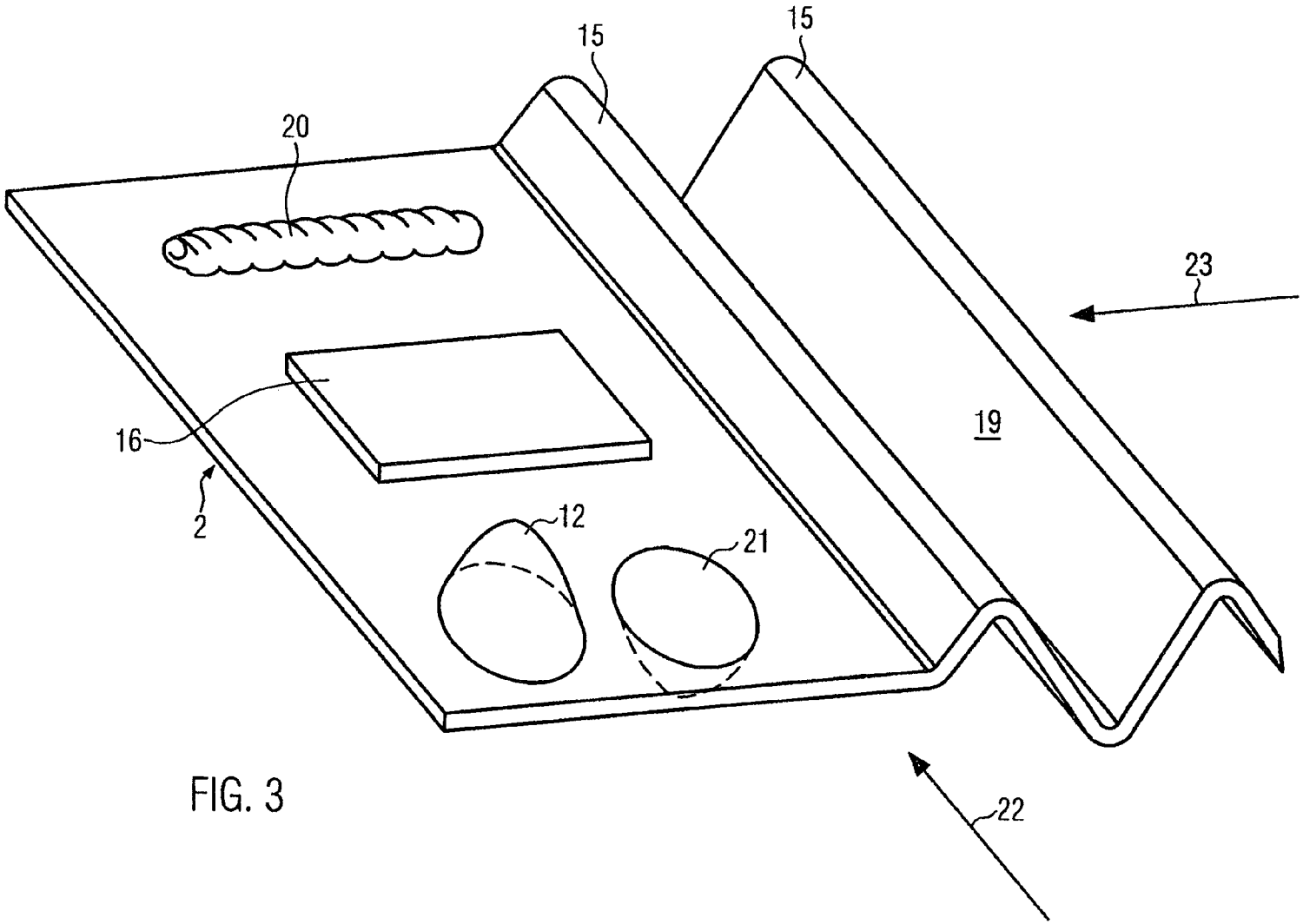
FIG. 3 shows a variant of supplies of material pre-formed according to the invention, especially punctiform, linear and plane designs.

FIG. 3 shows further embodiments to design the pre-formed supply of material 4 at the workpiece 2. A corrugated portion 19 can be seen, which is composed of waves 15, a build-up welding seam 20, a sheet 16 welded-on and a dent 12 and bulge 21. These are punctiform (mono-axis), linear (dual-axis) and plane (tri-axis) extensions of the pre-formed supply of material 4. A linear design may consist of several punctiform designs and a planar design may in turn be composed of a plurality of punctiform designs, and a planar design may be formed of a plurality of linear and/or dual-axial punctiform designs. The pre-formed supply of material 4 can extend longitudinally and transversely with respect to the longitudinal extension of the workpiece. The corrugated portion 19 is located e.g. longitudinally with respect to a first possible longitudinal extension 22 and transversely with respect to a second possible longitudinal extension 23. A sheet-like workpiece 2 is shown as an example, wherein its shape shall also not be restricted to this basic shape.

It should be appreciated that the foregoing description is illustrative in nature and that the present invention includes modifications, changes, and equivalents thereof, without departure from the scope of the invention.

The invention claimed is:

1. A workpiece (2) for explosion forming, which is insertable into a forming tool (1) and which is deformable from an initial shape (3) by means of explosion forming, wherein the initial shape (3) has at least in a portion a supply of material (4) for the explosion forming process which is pre-formed compared to adjoining portions, and wherein the pre-formed supply of material (4) comprises a material portion additionally applied to the workpiece (2).

2. The workpiece (2) as claimed in claim 1, wherein the pre-formed supply of material (4) comprises a pre-formed portion of the workpiece (2).

3. The workpiece (2) as claimed in claim 1, wherein the pre-formed supply of material (4) comprises a portion of thicker wall thickness.

4. The workpiece (2) as claimed in claim 1, wherein the pre-formed supply of material (4) is arranged on an outer side relating to a forming direction.

5. The workpiece (2) as claimed in claim 1, wherein the pre-formed supply of material (4) is arranged on an inner side relating to a forming direction.

6. The workpiece (2) as claimed in claim 1, wherein the pre-formed supply of material (4) is formed with an approximately punctiform design.

7. The workpiece (2) as claimed in claim 1, wherein the pre-formed supply of material (4) extends approximately linearly.

8. The workpiece (2) as claimed in claim 1, wherein the pre-formed supply of material (4) is formed in an approximately plane manner.

9. The workpiece (2) as claimed in claim 1, wherein the pre-formed supply of material (4) is formed at least as one of an indentation, a bulge, a recess, and an elevation in the wall of the workpiece.

10. The workpiece (2) as claimed in claim 1, wherein the pre-formed supply of material (4) is formed at least as one of a flute, a rib, a fold, a wave, a shoulder, and a groove.

11. The workpiece (2) as claimed in claim 1, wherein the pre-formed supply of material (4) is formed in a direction transverse with respect to the longitudinal extension of the workpiece (2).

12. The workpiece (2) as claimed in claim 1, wherein the pre-formed supply of material (4) is formed in a manner extending longitudinally with respect to a longitudinal extension of the workpiece (2).

13. The workpiece (2) as claimed in claim 1, wherein the pre-formed supply of material (4) extends over the circumference of the workpiece (2).

14. An explosion forming method comprising the steps of:

inserting a workpiece (2) into a forming tool (1); and forming the workpiece (2) in the forming tool (1) from an initial shape (3) to a final shape (10) by means of an explosion, and providing the initial shape (3) with at least one pre-formed supply of material (4).

15. The method as claimed in claim 14, wherein the pre-formed supply of material (4) is manufactured by forming a portion of the workpiece (2).

16. The method as claimed in claim 14, wherein the pre-formed supply of material (4) is manufactured by applying additional material to the workpiece (2).

17. The method as claimed in claim 14, wherein the pre-formed supply of material (4) is formed before inserting the workpiece (2) into the forming tool (1).

* * * * *